US008707876B2

(12) United States Patent
Higgins et al.

(10) Patent No.: US 8,707,876 B2
(45) Date of Patent: Apr. 29, 2014

(54) STEPPED FLOOR FOR SOLID FUEL BOILERS

(76) Inventors: Daniel Richard Higgins, Tigard, OR (US); Eugene Sullivan, Mobile, AL (US)

( * ) Notice: Subject to any disclaimer, the term of this patent is extended or adjusted under 35 U.S.C. 154(b) by 1235 days.

(21) Appl. No.: 12/557,085

(22) Filed: Sep. 10, 2009

(65) Prior Publication Data

US 2011/0259253 A1 Oct. 27, 2011

Related U.S. Application Data

(60) Provisional application No. 61/097,759, filed on Sep. 17, 2008.

(51) Int. Cl.
*F23L 1/00* (2006.01)
*F23C 7/02* (2006.01)

(52) U.S. Cl.
USPC ..... 110/347; 110/348

(58) Field of Classification Search
USPC ..... 110/248, 255, 257, 267, 268, 281, 282, 110/283, 284, 285, 291, 327, 328; 126/163 R, 152 B, 174, 175, 155, 157
See application file for complete search history.

(56) References Cited

U.S. PATENT DOCUMENTS

| | | | | |
|---|---|---|---|---|
| 1,716,224 A | | 6/1929 | Friderichsen | |
| 2,213,923 A | | 9/1940 | Stuart et al. | |
| 2,250,067 A | | 7/1941 | Martin | |
| 2,703,005 A | | 3/1955 | Dobermann | |
| 3,192,919 A | * | 7/1965 | Pieterse | 126/163 R |
| 3,932,970 A | | 1/1976 | Winders et al. | |
| 3,976,018 A | | 8/1976 | Boulet | |
| 4,170,183 A | | 10/1979 | Cross | |
| 4,183,330 A | | 1/1980 | Bruyers et al. | |
| 4,254,715 A | | 3/1981 | LaHaye et al. | |
| 4,270,468 A | | 6/1981 | Robinson et al. | |
| 4,423,533 A | | 1/1984 | Goodspeed | |
| 4,479,441 A | * | 10/1984 | Somodi | 110/257 |
| 4,528,917 A | * | 7/1985 | Jacobs | 110/300 |
| 4,577,363 A | | 3/1986 | Wyse | |
| 4,635,379 A | | 1/1987 | Kroneld | |
| 4,642,048 A | | 2/1987 | Kim | |
| 4,676,176 A | | 6/1987 | Bonomelli | |
| 4,756,360 A | | 7/1988 | Rawdon et al. | |

(Continued)

FOREIGN PATENT DOCUMENTS

JP 08-245072 9/1996

OTHER PUBLICATIONS

"Diamond Rodding Robot," http://www.diamondpower.com.au/pdf/diamondpower/AncillaryEquipment/Rodding_robot.pdf.

*Primary Examiner* — Kenneth Rinehart
*Assistant Examiner* — David J Laux
(74) *Attorney, Agent, or Firm* — Scheinberg & Assoc. PC; Michael O. Scheinberg; John B. Kelly

(57) ABSTRACT

A design and method of operation for the floor of solid fuel boilers is described. The combustion region includes a stepped-floor that improves combustion in the lower furnace. In some embodiments, the fuel is moved between the steps of the floor by a gas, rather than by mechanical means, and the fuel is moved from an upper to a lower step as it is burned. In some embodiments, the steps are fixed steps having a layer of a refractory material.

9 Claims, 3 Drawing Sheets

(56) References Cited

U.S. PATENT DOCUMENTS

| | | | | | |
|---|---|---|---|---|---|
| 4,822,428 | A | | 4/1989 | Goodspeed | |
| 4,872,834 | A | | 10/1989 | Williams, Jr. | |
| 4,884,516 | A | | 12/1989 | Linsen | |
| 4,955,296 | A | * | 9/1990 | Barlow | 110/300 |
| 4,976,208 | A | | 12/1990 | O'Connor | |
| 5,001,992 | A | | 3/1991 | Higgins et al. | |
| 5,069,146 | A | | 12/1991 | Dethier | |
| 5,226,375 | A | | 7/1993 | Fukuda | |
| 5,239,935 | A | | 8/1993 | Morrow et al. | |
| 5,313,892 | A | | 5/1994 | Tice | |
| 5,401,130 | A | | 3/1995 | Chiu et al. | |
| 5,414,887 | A | | 5/1995 | Abel et al. | |
| 5,724,895 | A | | 3/1998 | Uppstu | |
| 5,794,548 | A | | 8/1998 | Barlow | |
| 6,047,970 | A | | 4/2000 | Friend et al. | |
| 6,055,915 | A | * | 5/2000 | Bickell et al. | 110/186 |
| 6,358,042 | B1 | | 3/2002 | Moriguchi | |
| 6,532,880 | B2 | | 3/2003 | Promuto | |
| D510,146 | S | | 9/2005 | Attebery, II et al. | |
| 6,938,563 | B2 | | 9/2005 | Martin et al. | |
| D552,757 | S | | 10/2007 | Murdock | |
| 7,448,331 | B2 | * | 11/2008 | Beaumont et al. | 110/291 |
| 2004/0074167 | A1 | | 4/2004 | Drost | |
| 2006/0144348 | A1 | | 7/2006 | Viskup, Jr. | |
| 2009/0084327 | A1 | | 4/2009 | Cole et al. | |
| 2009/0270817 | A1 | | 10/2009 | Moreno et al. | |

* cited by examiner

STEPPED FLOOR FOR SOLID FUEL BOILERS

This application claims priority from U.S. Provisional Patent Application No. 61/097,759, filed Sep. 17, 2008, which is hereby incorporated by reference.

TECHNICAL FIELD OF THE INVENTION

The present invention relates in general to solid fuel boilers. In particular, the present invention relates to a solid fuel boiler with a stepped floor.

BACKGROUND OF THE INVENTION

Solid fuel boilers are commonly employed by industrial and commercial users to generate steam, thereby reducing dependence on traditional fossil fuels as sources of energy. Such boilers typically burn solid fuels and biomass, such as bark, coal, sludge, wood waste, refuse, tire derived fuel (TDF), and other organic materials, often in combination and with the addition of fossil fuels through a process called gasification, in which energy is extracted from the solid fuels.

Typical solid fuel boilers are constructed as large boxes (up to 100 $m^2$ or more in floor area) comprising heavy steel tubing for the walls. The tubes typically have an outside diameter of 63.5 mm or 76.2 mm and are arrayed parallel to one another, with their lengthwise ends running vertically, and spaced apart about 10-25 mm with a steel membrane or fin bridging the gaps to form substantially flat panels as walls. The entire assembly is seal welded together, forming an air tight structure. The boiler walls, or tube panels, run vertically to the top of the boiler, which can be up to 30 m or more tall. The walls are fed re-circulating water at their lower extremities by headers. Typically, the tubes forming the front wall of the box bend at the upper portion of the box to form a substantially horizontal roof over the box. The side walls culminate at the upper portion of the box in relieving headers, which in turn feed back to a steam drum. The rear wall at its upper portion either ends in a header or feeds directly into the steam drum. In order to feed fuel and combustion air into the boiler, and for other purposes, the boiler tubes are bent apart to form openings in the tube panel. There are typically multiple fuel chutes penetrating a wall or walls of the boiler. In common practice, solid fuel is gravity fed from a hopper and/or conveyor system through the large (about 0.25 $m^2$ in area), steeply mounted chutes to the lower portion of the boiler just above the grate or fluidized bed. A solid fuel distributor is often integrally connected with the bottom portion of a chute where the chute interfaces with the boiler wall. In grate-type boilers, mechanically or pneumatically operated fuel distributors are typically required, whereas fluidized bed boilers can be operated without as the fluidized sand bed by design distributes the fuel.

Although it should be appreciated that solid fuel boilers may come in different shapes or sizes, they are distinguished primarily upon the design of their lower furnaces. To this end, solid fuel boilers are broadly categorized into either sand-bed (fluidized) or grate-fired boilers. Both types show inherent design flaws that prevent them from operating at their full capacities and/or cause them to break down frequently. Additionally, they both suffer from poor combustion efficiencies due to relatively low heat tolerance and poor control of combustion air in the lower furnaces. In either case, decreased efficiency and increased operational or maintenance costs are observed. Although the shortcomings of each type of boiler will be discussed in greater detail below, sand-bed, or fluidized-bed, boilers generally suffer from sand erosion of the parts through which high pressure water and steam are carried causing them to be de-rated or to require frequent repair. Grate-fired boilers generally suffer from high maintenance costs and operational problems associated with the moving parts comprising the grates. Both types of boiler suffer from poor combustion efficiencies due to the relatively low heat tolerance of the grate or bed and poor control of combustion air in the lower furnace.

Grate-type boilers include those with traveling grates, vibrating grates, tilting grates, or hydro-grates. In a typical grate-type boiler, the grates cover the bottom of the boiler floor and are made of heavy cast iron components with holes or slots for combustion air (called under-grate air) to be forced through from a plenum below. In operation, solid fuel lands on the grates from above and burns on the grates' upper surfaces. The resulting ash is dumped off as the grates move (rotate like a tank tread), vibrate, or tilt (in sections). Grate-type systems suffer from costly maintenance and operational problems. For instance, in the case of traveling grates, the grate is made up of hundreds of individual segments similar to chain links that form a rotating "tank tread" across the width of the boiler. These parts are subject to mechanical wear due to frictional contact between the many moving parts and attack from the hot boiler environment. Maintenance of traveling grates can typically cost tens of thousands of dollars per year, and replacement costs can amount to hundreds of thousands.

Another type of grate is the reciprocating stepped grate as described, for example, in U.S. Pat. No. 5,069,146 to Dethier, U.S. Pat. No. 4,676,176 to Bonomelli, and U.S. Pat. No. to 4,884,516 to Linsén. In the reciprocating stepped grate, reciprocating steps between fixed steps force the fuel down a series of steps. Combustion is provided between the fixed and reciprocating steps.

Operationally, grate systems suffer to some extent from problems of fuel piling and combustion air "short-circuiting." For instance, when solid fuel lands on the grate, especially at higher load rates and/or with higher humidity content of the solid fuel, piles of fuel are often formed thereon. The piles of fuel may form with such depth and density that the grate air cannot be forced through the grate from below. Therefore, the grate air is said to "short-circuit" as it is forced around the pile, resulting in less available air as required to burn the pile and more air to burn any thinner material surrounding the pile. This scenario of short-circuiting not only exacerbates the situation of pile formation, but further results in non-uniform combustion across the hearth of the furnace. To combat this, grate-fired boilers are often run at reduced load rates, higher travel speeds, and with extra under grate air. The use of extra air, in particular, reduces the combustion and thermal efficiencies of the boiler and can lead to excess emissions. Further, moving grate systems suffer from seal failures between the grates and the boiler walls, leading to excessive air leakage and even more short-circuiting and use of excessive under grate air. Mechanical grates also must be cooled to prevent premature failure. Many grate systems rely on a large flow of under grate air for cooling. This limits the combustion control flexibility as the grate air has a large minimum air flow requirement for cooling. Hydro grates utilize water cooled tubes to support the fuel during combustion and may not require as much under grate air, however, the water cooled tubes cools the fuel pile and reduces the combustion efficiency. Due to the relatively low temperature tolerance of mechanical grates, and the inherently cool nature of hydro-grates, both of these systems must be run at temperatures much lower than optimum for combustion purposes.

Fluidized bed boilers, including those with circulating fluidized beds or other arrangements, generally have a mass of sand or other media, forming a bed across the floor of the boiler through which a stream of combustion air, or an air and boiler flue gas mixture, is percolated to fluidize the bed. In other words, due to the percolating air the sand bed behaves as a fluid, and is said to be "fluidized". Solid fuel particles float inside the fluidized sand bed, suspended by the turbulent motion of the sand and air. The fluidized bed—comprising a hot mass of fluidized sand—acts as a heat sink, fuel drying system, turbulent fuel/air mixing system, fuel distribution system, and means for separating fuel and ash in the boiler. These boilers commonly suffer from maintenance problems because the sand is very abrasive, frequently causing leaks in the pressurized parts of the boiler. To remedy this problem, these boilers are commonly de-rated, that is, operated at less-than-optimal output. Fluidized bed boilers also suffer from poor combustion and thermal efficiencies because the amount of fluidizing air required is often dictated by the need to fluidize the bed. It is difficult, therefore, to control the amount of fluidizing air on a stoichiometric basis.

In order for the fuel to burn efficiently it must be mixed with the combustion air in an aggressive manner. Typically the fuel slides down the chute and enters the boiler with high residual moisture content (up to 50% or more). The water in the fuel inhibits combustion in the furnace, often requiring the continual use of supplemental fossil fuels or a fluidized bed to provide additional heat transfer to compensate for moisture swings. It is also very common for the load rate on these boilers to change frequently in reaction to changing steam demands. Inconsistent and high moisture content of the fuels makes it difficult for the boiler to respond effectively to the required load changes. This requires, again, the use of supplemental fossil fuels to improve the response of the boiler to load rate changes. Fossil fuels are typically used to start these boilers but continual use of fossil fuels is extremely expensive. Fluidized beds in particular can help to compensate for varying moisture contents and load rates because they act as heat sinks, but they can have significant operational and mechanical problems such as sand sintering and sand erosion and they require a sand reclamation system. Fluidized sand beds also have a temperature limit that is well below the optimum temperature of combustion for many fuels. This limits the efficiency of combustion.

To alleviate the problem of incomplete combustion, additional combustion air, typically called over fired air (OFA), is injected into these boilers above the grate or fluidized bed to help complete the combustion. In practice, however, the design of the OFA systems is seldom adequate to overcome the deficiencies of the under grate or fluidizing air system.

Embodiments of the present invention address many the aforementioned disadvantages of these types of solid fuel boilers.

SUMMARY OF THE INVENTION

An object of the invention to provide an improved means for burning solid fuels without the need for a moving mechanical grate or sand-filled fluidized bed.

The present invention includes a combustion region that includes a stepped-floor that improves combustion in the lower furnace. In some embodiments, the fuel is moved between the steps of the floor by a gas, rather than by mechanical means, and the fuel is moved from an upper to a lower step as it is burned. In some embodiments, the steps are fixed steps having a layer of a refractory material.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and the advantages thereof, reference is now made to the following descriptions taken in conjunction with the accompanying drawings, in which.

DETAILED DESCRIPTION OF THE PREFERRED EMBODIMENTS

Embodiments of the present invention include a method and apparatus for burning solid fuel in a lower furnace region that includes a stepped-floor. In one preferred embodiment, a solid fuel boiler includes a series of fuel support surfaces arranged in steps for the floor of the boiler. A gas inlet system is also provided, wherein each step preferably incorporates beneath it or within it an air plenum and nozzle to provide combustion air directly to the fuel supported on the subsequently lower step.

The steps are preferably arranged to allow primary air, or combustion air, from below at least some of the steps to be provided to the solid fuel that may land on the upper surface of the steps, thereby blowing across the top of each step and fanning the combustion of the fuel on those steps. The combustion air blows at such a pressure that as the fuel dries, burns, and is reduced in size it is eventually blown down to the successive lower step. This process is reiterated with each step until the ash that remains from the combustion will either be blown into suspension where it is fully combusted above the steps, or will fall through a gap provided after the lowest step and into an ash handling system below. Preferred embodiments incorporate steps in the floor of the boiler with the riser of each step incorporating an air plenum and nozzle along its length that provides combustion air directly to fuel landing on the steps. The nozzle may be a separate component or may be formed by the air plenum structure. Periodically the flow of gas mixture through the nozzles may be increased to force the excess fuel/residual ash off upper steps onto lower steps and, ultimately, into a removal means beneath the lowest step in the series of steps. Alternately, pressurized steam or water may be used by a separate means to periodically blow residual material from the steps. Additionally, a feedback control system may automatically sense excess fuel formation on the steps and actuate the increase of gas pressure or velocity of the inlet system.

Figure 1:
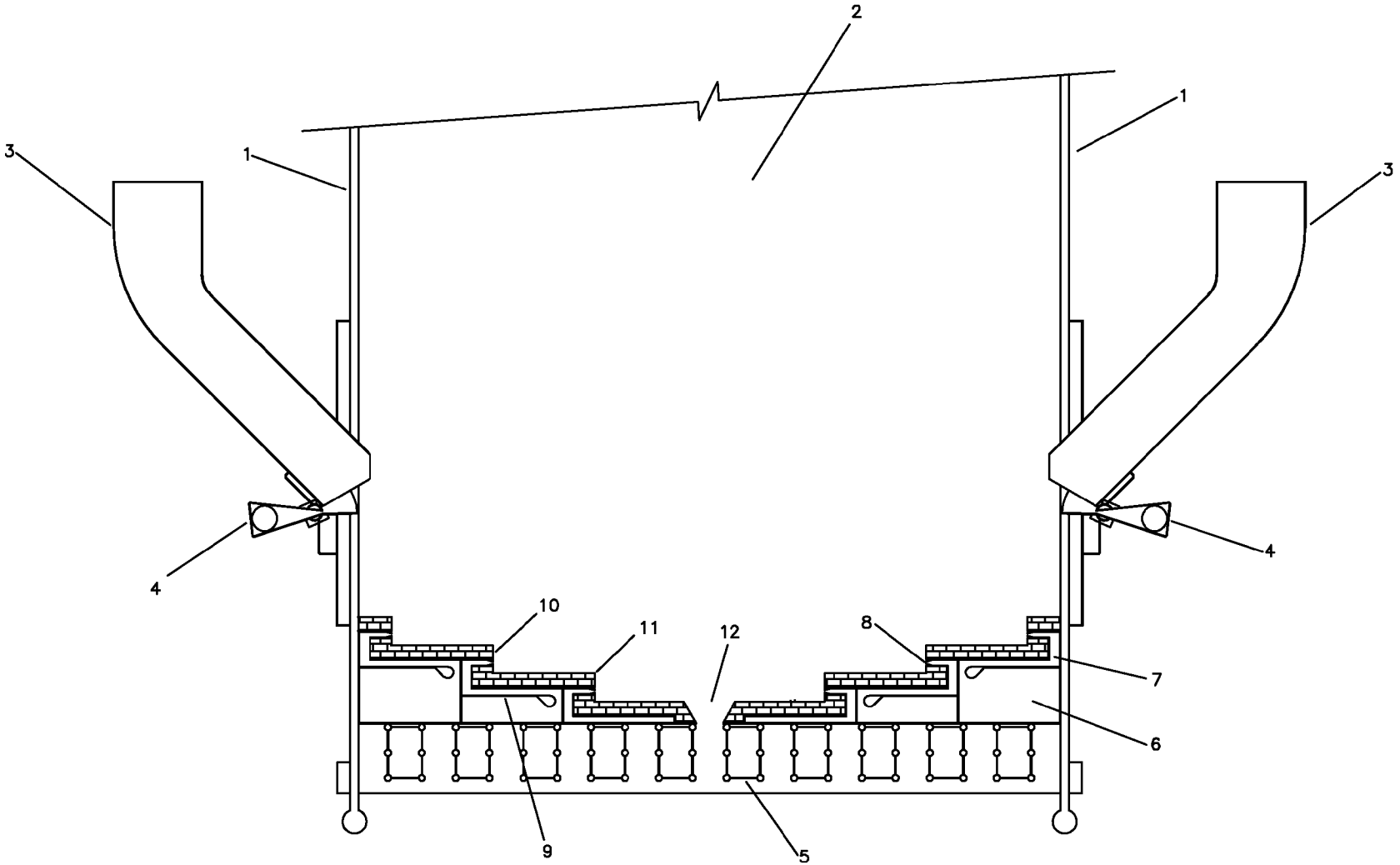
FIG. 1 shows a sectional elevation view of the lower portion of a boiler of a preferred embodiment of the present invention.

Referring to FIG. 1, a preferred embodiment of the stepped floor for a solid fuel boiler of the present invention is shown to generally comprise tubes 1 surrounding the combustion chamber 2. It is to be understood that walls of the solid fuel boiler may be made of tubes, a refractory lined box, a combination of the two, or any equivalent enclosure. Fuel inlets such as fuel chutes 3 are arranged to direct fuel through walls 1. Fuel distributors 4 are disposed at the base end of chutes 3 to aid in dispersing incoming fuel. In a preferred embodiment of the present invention, gas inlets that provide gas for combustion of the solid fuel on the support surfaces and for moving fuel to the subsequent support surface preferably include air ducts 5 that run under boiler-feeding air plenums 6, which are in turn connected to channel ducts 7 that terminate in air nozzles 8 between adjacent steps 10. A steel support structure 9 supports the floor and forms the plenums 6, channel ducts 7, and nozzles 8. The floor is preferably arranged in a series of fuel support surfaces or steps 10 that are preferably lined with refractory brick 11 or other suitable material. A spent fuel exit or gap 12 between the two lowest steps communicatedly connects the interior of the boiler to an ash removal system below (not shown).

In the embodiment of FIG. 1, three steps on each side of the boiler successively descend to the gap 12 in the middle of the boiler. In at least one preferred embodiment, each step and each nozzle assembly substantially extends the full inside width of the boiler as shown in FIG. 1. Other embodiments may have a different quantity of steps, different step height to width ratios, or may have steps that extend from one wall to an opposite wall, culminating with a gap between the final step and the opposite wall. The gap may be sealed with a water trap (not shown) as is known to skilled artisans. In another embodiment a movable grate may close the gap and allow periodic dumping of the ash that lands thereon. Those of ordinary skill in the art will appreciate that a preferred arrangement of steps may be dependent on the size of the boiler and the arrangement of the fuel chutes and fuel distributors. Larger boilers with fuel chutes and distributors on opposite walls may benefit from a floor that steps down from the opposite walls toward the center of the boiler, separated by a gap. Smaller boilers with fuel chutes and distributors on one side may benefit from a floor that steps down from one wall substantially to the opposite wall, separated by a gap. In the latter case, the high end of the floor would typically be opposite the fuel chutes and distributors, while the lower end and gap would be on the same side or wall as the fuel chutes and distributors.

Figure 2:
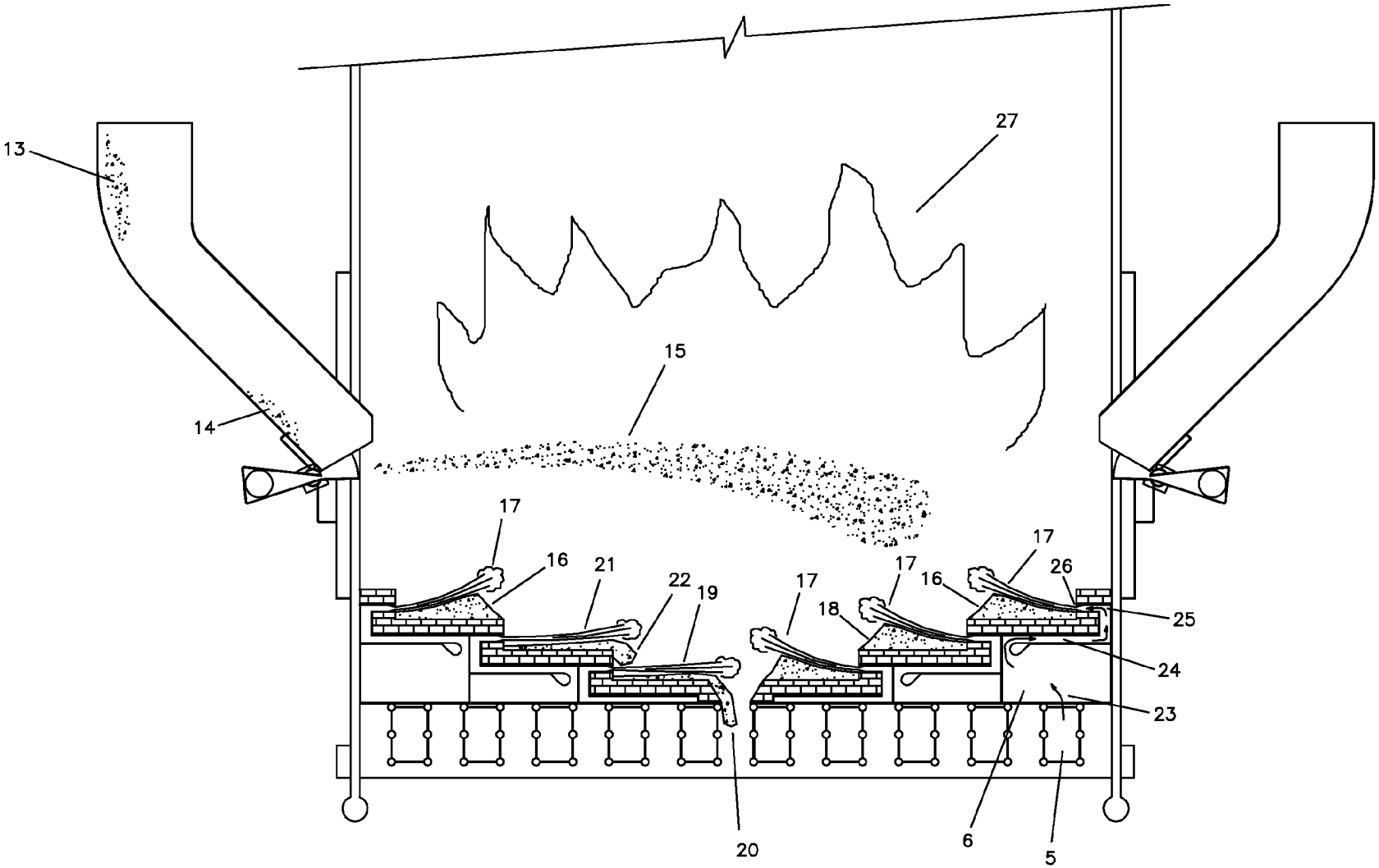
FIG. 2 shows the boiler of FIG. 1, further depicting its operation.
Figure 3:
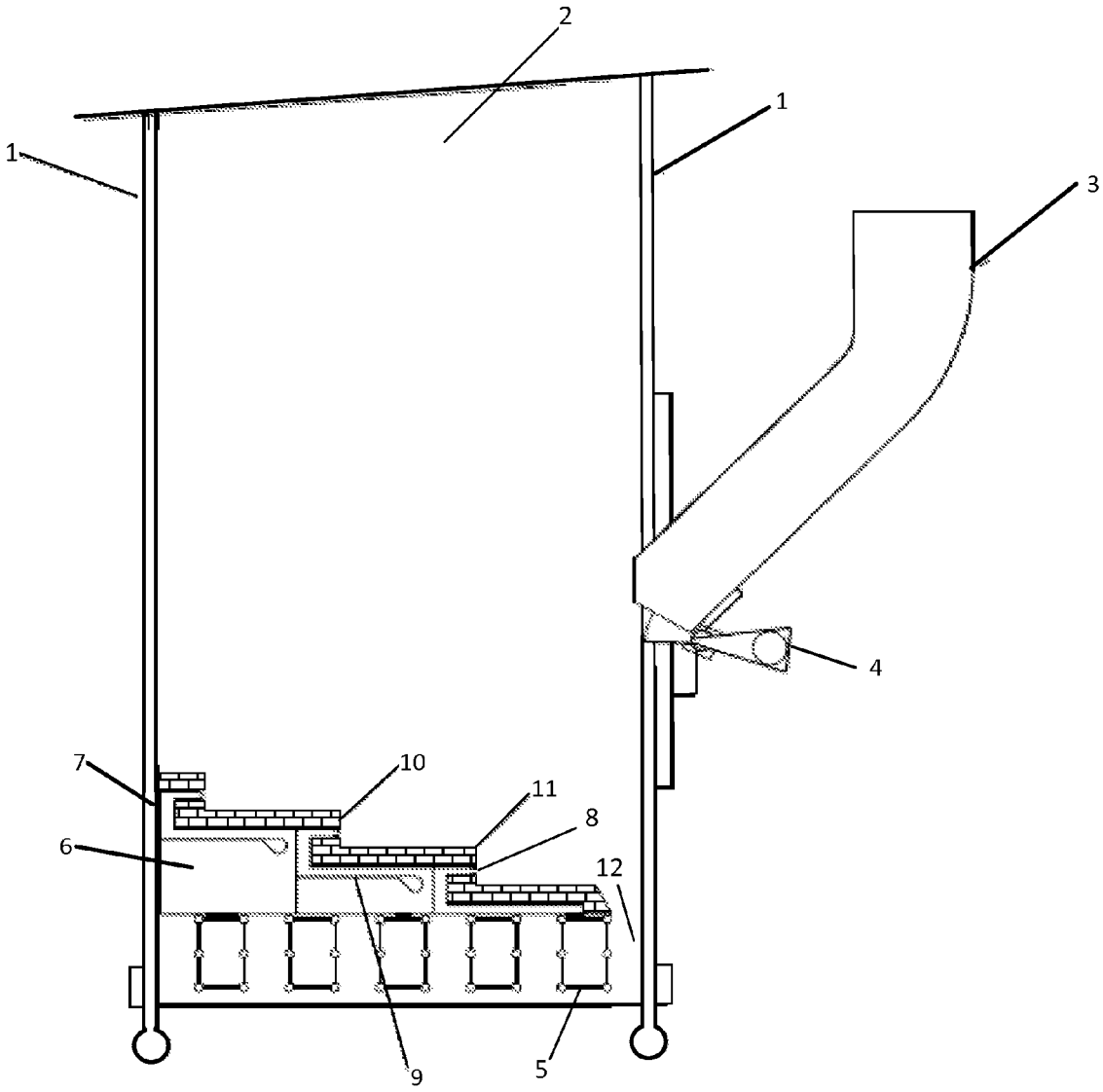
FIG. 3 shoes a sectional elevation view of the lower portion of a boiler of an embodiment of the present invention.

Referring now to FIG. 2, operation of a preferred embodiment of the boiler is shown. Fuel descends from above at 13, slides down the chute at 14 and is injected into the boiler at 15. Although FIG. 2 shows fuel being injected from one side, it is to be understood that fuel may also be injected from more than one side at the same time. Fuel may be injected into the boiler, or placed on the steps, by any method or structure, and it should be understood that any structure or method that places fuel on the steps of the present invention are within the breadth of this disclosure. If there are fuel chutes and fuel distributors on opposite walls, as shown in the embodiment of FIG. 2, fuel is typically injected from both walls and the processes described below occur on both sides of the boiler. The injected fuel 15 flies across the combustion chamber through the fireball 27 inside the combustion chamber. Smaller fuel particles will dry very quickly and burn while in suspension, thereby helping to sustain the combustion. Larger particles will begin to dry in flight, but what does not burn in suspension will carry across the boiler and land on steps 16, preferably the uppermost step of the opposite side. Combustion air 17 blows across the top of each step, preferably continuously, fanning the combustion of the fuel on that step. As the fuel dries and burns, the fuel particles are reduced in size and may become ash. As taught herein, the combustion air blows with sufficient pressure and velocity to eventually (once the particles are sufficiently reduced in size and weight) force the particles or ash to the next lower step 18 where they may continue to burn with the supplied combustion air 17 provided over that step. To this end, it is preferable that the step above a successive lower step overlap the lower step so as to better prevent fuel particles or ash from entering the nozzle 8, channel duct 7, or plenum 6. This process continues until all of the steps are engaged in burning the fuel or until they become over laden with ash. It will be appreciated that while the fuel is burning on the steps, smaller particles may be blown into suspension, or into the fireball, where they are fully combusted. Because the fuel is being burned as it moves from step to step, in some embodiments it may be preferable to make the steps of differing widths to reflect the changing properties of the fuel and ash as it moves from step to step. In some embodiments, some or all of the steps may be tilted, that is, the orientation of the surface of some or all of the steps may vary from the horizontal.

There is a certain amount of air required at each step to maintain suitable fuel depth or height and to distribute fuel to the lower steps. This air may contain more oxygen than what is desired for good combustion. Therefore, in preferred embodiments, the amount of oxygen supplied to each step is controlled or regulated by mixing the combustion air with re-circulated boiler flue gas (FGR) that is oxygen depleted. By varying the mixture, the appropriate amount of oxygen can be delivered while still physically controlling the fuel levels. In general, the amount of oxygen supplied to the floor through the steps will be significantly less than the stoichiometric requirement to burn the fuel. Also in preferred embodiments, additional combustion air is supplied through over-fired air ports (not shown) that sustain the fireball 27 and complete the combustion. Heat from the fuel burning on the steps and from the fireball 27 will gasify the solid fuel and that gas will be burned in the fireball 27. Additionally, controlling the combustion air entering through the steps will limit the emissions produced by the boiler, especially oxides of nitrogen (NOx). When the fuel is burned sub-stoichiometrically, the oxygen is preferentially consumed in the combustion reactions and is not available to react with the nitrogen in the fuel thereby limiting "fuel" NOx. Furthermore, as taught herein, controlling the oxygen levels in the lower furnace will control combustion temperatures limiting "thermal" NOx. Nitrogen and oxygen are present in the air in percentages of 21% oxygen and 79% nitrogen. If combustion temperatures are allowed to rise to approximately 2200° F., the nitrogen will bond with the oxygen to form NOx, which is a pollutant emission. The ability to precisely control oxygen levels in the lower furnace is unique to the present invention because those situations that typically cause uncontrollable oxygen concentrations, such as fuel piling, short-circuiting and air leaks, are averted by the present invention. With the arrangement of steps as taught in the present invention, piling is automatically controlled and no short-circuiting of the air can occur, and because there are no air seals to leak due to sand or moving parts, external air cannot penetrate the combustion chamber.

Periodically, the amount of ash accumulated on the steps will interfere with the combustion of the fuel. When that happens, according to preferred embodiments of the present invention, the pressure of the air or air/FGR mixture may be momentarily increased 19 to blow the ash off of the lowest step. The lowest steps will accumulate most of the ash and when the ash is blown off the step, it will fall through the gap 20 and into an ash handling system below. The upper steps will also be "blown" 21 periodically to push the remaining fuel and ash to the next lower step 22. In an alternate embodiment, the floor will step down from one side all the way to the other side and terminate with a gap between the lowest step and the wall. In that case the ash from the lowest step is blown into the gap between the step and the wall, and then falls into the ash handling system. An alternate embodiment incorporates a pressurized steam and/or water ash blowing system consisting of a series of nozzles incorporated into the steps. The nozzles are spaced along a pipe oriented along each step and arranged to oscillate back and forth. Periodically, pressurized steam or water can be directed along to tops of the steps to remove any foreign material adherent thereto.

The presence of the refractory or refractory brick 11 protects and insulates the steel floor structure from the heat of the combustion and retains heat in the boiler improving the gasification of the fuel. The refractory or brick may be installed in multiple layers consisting of refractory or brick with different thermal properties. The lower level may be a material with high thermal insulating properties to reduce heat transfer to the supporting structure and to retain heat in the boiler. An upper layer may be of material with high temperature and high thermal shock resistance with a high heat capacity. The upper layer then is more suitable for the physical and thermal loads and acts as a heat sink to aid in the combustion process. Each step is provided with an air plenum 6 that incorporates a means (not shown) to control the air or air/FGR pressure supplied to that plenum. As shown by arrow 23, the air or air/FGR mixture flows into the plenum 6 from the duct 5, then is forced to flow under the floor through floor duct 24, then around the inside edge of the step through a vertical duct 25, and finally exits at the nozzle 26. The floor duct 24 is preferably arranged to increase the velocity of the air or air/FGR flow so as to improve the convective heat transfer from the metal floor to the air or air/gas mixture. In this way the flow of combustion air or air and FGR to the steps will cool the floor under the refractory or bricks.

In the aforementioned embodiments, the height of the fuel on the steps is described to be controlled by the flow, velocity, temperature, or pressure of steam, water, air, gas, or any mixture thereof by manual regulation. Self, or automatic, regulation of the height of the fuel on the steps is also contemplated herein. One of ordinary skill in the art will readily recognize that a feedback loop control system arranged to sense the height of the fuel pile may be employed to increase the pressure, velocity, temperature or flow of the air, gas or mixture provided through the nozzle toward the fuel pile. For instance, such a feedback control system may include sensors that measure an increase in resistance of the provided air mixture pressure through the nozzles to indicate a buildup of the fuel pile beyond a threshold limit. The sensor would then signal an actuator to increase the pressure, velocity, or quantity of air mixture. Any such feedback loop control system that can be utilized for this purpose by a skilled artisan without undue experimentation may be employed. For instance, a sensor might detect the temperature of a portion of the fuel pile or the weight of the fuel pile to signal the actuator. Also, the velocity, pressure, temperature, or volume of the air mixture may simply be increased or decreased periodically on a time-based schedule. In this instance, a skilled artisan will recognize that a feedback loop system is not required.

An alternate embodiment of the invention also includes a refractory lining on the inside of the boiler wall tubes or a section of the lower boiler that is devoid of water cooled tubes and instead has a steel support structure that is lined on the inside with refractory and insulated on the outside. Both of these embodiments including refractory elements are intended to increase the heat in the lower furnace that is returned to gasify the fuel.

In some embodiments, there is a gap between the top of one step and the bottom of the adjacent steps from which gas can enter the combustion area; in other embodiments, the top surface of one step can be at about the same height as the bottom of the preceding step so that there is no gap between the steps, with the nozzles for gas located within the step and the gas being emitted from the vertical face of the step. In other words, the nozzles may be located within the step or otherwise in the vertical edge of the step, being provided with air mixture from plumbing that is at least partially within the step.

In preferred embodiments of the invention, fuel is moved from one step to a lower step without using mechanical means, that is, without a device such as a pusher or scraper that contacts the fuel. In a preferred embodiment, the fuel is moved from one step to a lower step by the movement of gas. The gas is preferably injected between the steps or above a step. The gas can be injected horizontally, parallel to the step surface, or at an angle of less than 45 degrees from the horizontal. In some embodiments, a mechanical means can be used in some parts of the fuel path without departing from the invention. For example, a mechanical device may be used to move material onto or off of any step. The mechanical means preferably does not comprise a movable step between the fixed steps, that is, the mechanical means preferable does not comprise a flat surface that extends from the gap between steps. A preferred scraper may include, for example, a front face, perpendicular to the top surface of the step and no substantial surface parallel to the surface of the step. For example, a preferred mechanical means could comprise a blade that extends from between the steps of from the side wall of the combustion region.

Preferred embodiments of a solid fuel boiler of the present invention include a combustion chamber floor arranged in fixed steps. Preferably, the fuel and/or ash is moved from an upper step of the floor to a respectfully lower step without moveable steps or steps having moveable parts. The steps may originate on two opposite walls and step down toward the middle or, alternatively, the steps originate on one wall and step down toward the opposite wall. Also, the steps may originate on the wall opposite the fuel distributor(s) and step down toward the fuel distributor(s). The steps may act as expansion joints.

In some preferred embodiments, the ash falls through a gap adjacent to the lowest step or steps. The gap is preferably sealed with a water trap. In an alternate embodiment the gap is bridged by a movable grate that allows for periodic dumping of the ash into the gap below.

Preferably, fuel is at least partly burned and/or gasified on the steps. Also preferably, fuel is at least partly burned or gasified in suspension. Preferably, the fuel is burned and/or gasified on or above the floor sub-stoichiometrically.

Preferred embodiments of the steps of the solid fuel boiler of the present invention include a vertical portion having one or more nozzles for supplying a gas such as, for example, steam, water, combustion air, re-circulated flue gas, or any mixture thereof.

Preferably, a nozzle is included between successive steps, such that a nozzle is positioned between a first upper and respective lower second step to direct the fuel and/or ash toward the successively lower third step below the second step. In some preferred embodiments, the nozzle(s) supplies fuel with oxygen.

In some preferred embodiments, the mixture ratio, pressure, temperature, velocity and flow or direction of the gas is preferably regulated. Also in some preferred embodiments, the height of the fuel on the steps is controlled by the flow, velocity, temperature, or pressure of steam, water, air, gas, or any mixture thereof.

In preferred embodiments, a fuel distributor delivers fuel mostly to the upper step or steps. A pneumatic fuel distributor may be used. As explained in detail above, the fuel is then distributed to lower steps by directed gas from between the steps, and may be periodically distributed to lower steps by purposeful adjustment of the flow, velocity, or pressure of gas. Preferred embodiments include removing ash from the lowest step or steps by the gas mixture. Alternate embodiments include mechanical means to move the ash and/or fuel from an upper step to a lower step while the steps themselves do not move.

In preferred embodiments, the steps are lined with brick, refractory, or other heat resistant and/or wear resistant and/or thermally insulating material. The steps may be cooled by the flow of the gas mixture.

In preferred embodiments of the present invention for burning solid fuels, air, gas, steam, water, or any mixture thereof can be introduced to a combustion chamber in a horizontal fashion at points originating in the interior of the combustion chamber (in other words the air jets or nozzles are directing the gas mixture horizontally but not just at the perimeter of the boiler). Some preferred embodiments may incorporate the introduction of combustion air and/or recirculated flue gas or a mixture thereof at least one elevation above the stepped floor.

In some preferred embodiments, the fuel distributors are angularly adjustable.

In some preferred embodiments, the stepped floor of the present invention is supported from the ground but the boiler is supported from above, being hung. Alternatively, the floor and the boiler are both supported from the ground. Sliding seals may be incorporated between the system and the boiler walls.

Preferably, at least one fuel chute delivers fuel to the system. Also, hot combustion gas may be made to flow through the fuel chute(s). The stepped floor of the present invention may be incorporated into a new boiler or retrofitted to an existing boiler.

Preferred embodiments of the present invention reduce emissions and/or control the formation of NOx.

A preferred combustion chamber for a solid fuel boiler including the stepped floor of the present invention includes a fuel inlet for providing solid fuel to the combustion chamber interior and a solid fuel combustion region having:

a first support surface for supporting a solid fuel;

a second support surface for supporting the solid fuel, the second support surface being positioned at least in part below the first surface; and a gas inlet for providing gas for moving the fuel between first and second support surfaces;

the solid fuel moving from the fuel inlet to the solid fuel combustion region, at least some of the fuel moving without mechanical means from the first support surface to the second support surface as it is combusted.

A preferred embodiment of the present invention includes a spent fuel exit for removal of spent fuel from the combustion region, the solid fuel moving between the support surfaces and the spent fuel exit without engendering relative motion between components of the floor. Preferably, a gas inlet is positioned so that gas (e.g. a mixture of air and flue gas) is introduced between the first and second support surfaces, or between adjacent support surfaces. The first, second, and additional support surfaces preferably form a series of support surfaces, from the first support surface to a last support surface, each support surface in the series being positioned below the previous support surface.

Preferred embodiments of the present invention include support surfaces which include refractory material on which the fuel is burned, the non-metallic refractory material preferably includes refractory brick or multiple layers of refractory with different mechanical and/or thermal properties.

Preferred embodiments of the present invention include support surfaces in which the end of the first support surface extends to or past the beginning of the second support surface, and so on with respect to subsequent support surfaces, so that fuel falling from the end of the first support surface lands on the second support surface, etc.

In preferred embodiments, gas flows under at least one of the first and second support surfaces to cool the at least one of the first and second support surfaces prior to the gas flowing through the gas inlet or nozzle.

Preferred embodiments may further comprise one or more sensors to determine whether accumulating fuel is interfering with gas flowing form the gas inlet or nozzle.

In some preferred embodiments, the gas inlet or nozzle is positioned within the support surfaces themselves, instead of between adjacent support surfaces. Also, a fuel inlet preferably distributes fuel onto one or more of the support surfaces.

A preferred embodiments of the present invention for burning solid fuel includes:

a first support surface for supporting a solid fuel;

a second support surface for supporting the solid fuel, the second support surface being positioned at least in part below the first surface; and a gas inlet for introducing a gas above the first support surface, the gas inlet configured to force the fuel from the first support surface to the second support surface.

Preferred embodiments further include subsequent support surfaces below the second support surface in a stair-like fashion, and gas inlets between the first and second support surfaces and subsequent support surfaces, in which the introduction of gas forces fuel from the upper support surfaces to subsequently lower support surfaces. Preferably the support surfaces are fixed so that they do not move with respect to each other for the purpose of forcing fuel from an upper support surface to a lower support surface.

Preferred embodiments include the first support surface and second support surface positioned to provide a gap between the surfaces, the gap including the gas inlet. In other preferred embodiments the gas inlet is positioned in the step. The first support surface may be the top surface of a first fixed step in a staircase arrangement of steps, and the second support surface is the top surface of a second fixed step.

Some preferred embodiments may also include a scraper, such as a blade, for moving material from an upper support surface to a lower support surface.

A solid fuel boiler, comprising:

a system for burning solid fuel as described above;

a fuel inlet; and a spent fuel exit.

The solid fuel boiler of the present invention may further include a solid fuel spreader for spreading fuel as it enters the system for burning solid fuel.

A preferred method of the present invention for burning solid fuel includes: directing solid fuel into a combustion chamber and onto a first fixed support surface where the fuel is partly combusted;

directing a gas toward the solid fuel on the first fixed support surface, the gas being used in the combustion of the solid fuel on the first fixed support surface and being used to move the solid fuel from the first fixed support surface onto a second fixed support surface where the fuel is further combusted, the second fixed support surface being lower than the first fixed support surface; and directing a gas into the solid fuel onto the second fixed support surface, the gas being used in the combustion of the solid fuel on the second fixed support surface and being used to move the solid fuel from the second fixed support surface onto an subsequently lower fixed support surface or into a spent fuel exit.

Preferred methods of the present invention include directing a gas from an inlet below the first fixed support surface and above the second support surface, the support surfaces being the upper surfaces of steps. Also in preferred embodiments, the inlet is between the steps or support surfaces. The support surface may be at least partially made of refractory brick.

Preferred methods for directing a gas into the solid fuel on the second support includes first passing the gas under the second support surface to cool the second support surface. This may be performed on other steps as well.

Preferred methods also include determining when solid fuel is obstructing the gas flow and increasing the gas flow to remove the obstruction.

A method of burning solid fuel comprising:

delivering fuel to a series of support surfaces on which the solid fuel is partly combusted or gasified, each support surface being lower than the previous support surface; and delivering gas to the solid fuel on the series of support surfaces, the gas being used in the combustion of the solid fuel and being used to move the solid fuel between the support surfaces, the gas being introduced between at least two of the support surfaces.

Although embodiments of the present invention and their advantages are described in detail above and below, it should be understood that the described embodiments are examples only, and that various changes, substitutions and alterations can be made herein without departing from the spirit and scope of the invention as defined by the appended claims. The scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. For instance, embodiments of the present invention may include a system in which the boiler rests on the bottom of the combustion chamber or in which the boiler is hung from the top of the chamber; in which sliding seals are incorporated between the system and the boiler walls; in which the system and the boiler are supported from the ground; in which the system is supported from the boiler walls; or in which hot combustion gas is made to flow through the fuel chute(s). Embodiments of the present invention may also include systems in which the steps act as expansion joints; in which the height to width ratio of the steps can vary within the system or from system to system; or in which the system moves with the boiler as it expands and contracts. Accordingly, the appended claims are intended to include within their scope such processes, machines, manufacture, compositions of matter, means, methods, or steps.

We claim as follows:

1. A method for burning solid fuel in a solid fuel boiler comprising:

directing solid fuel into the combustion chamber of the solid fuel boiler and onto a first fixed support surface;

directing a gas toward the solid fuel on the first fixed support surface, the gas aiding in the combustion of the solid fuel on the first fixed support surface and moving at least a portion of the solid fuel from the first fixed support surface onto a second fixed support surface where that portion of fuel is further combusted, the horizontal plane of the second fixed support surface being vertically lower than the horizontal plane of the first fixed support surface, and determining when solid fuel is obstructing the gas flow and increasing the gas flow to remove the obstruction.

2. The method of claim 1 wherein the gas is a mixture of combustion air and re-circulated boiler flue gas.

3. The method of claim 1, further comprising directing a gas toward the solid fuel on the second fixed support surface, the gas mixture aiding in the combustion of the solid fuel on the second fixed support surface and for blowing the solid fuel from the second fixed support surface onto a subsequently lower fixed support surface or into a spent fuel exit.

4. The method of claim 1, further comprising directing a gas from an inlet below the first fixed support surface and above the second support surface, the support surfaces being the upper surfaces of steps.

5. The method of claim 1, further comprising regulating at least one parameter from the group consisting of gas mixture ratio, gas pressure, gas temperature, gas velocity, gas flow, and gas direction.

6. The method of claim 1, further comprising determining whether the amount of solid fuel upon at least one of the plurality of support surfaces is beyond an upper or lower limit; and regulating the amount of solid fuel upon the at least one support surface by adjusting the gas mixture ratio, pressure, temperature, velocity, flow, or direction.

7. The method of claim 1, further comprising directing the gas to pass beneath at least one of the plurality of steps before being directed to the support surface of that step.

8. The method of claim 1 wherein moving at least a portion of the solid fuel includes moving at least a portion of the solid fuel without a mechanical pusher or scraper that contacts the fuel.

9. The method of claim 1 wherein moving at least a portion of the solid fuel includes blowing at least a portion of the solid fuel by the gas.

* * * * *